United States Patent [19]

Christensen et al.

[11] Patent Number: 4,761,562

[45] Date of Patent: Aug. 2, 1988

[54] PHOTOELECTRIC CONTROL SYSTEM FOR MOVING STORAGE UNITS

[75] Inventors: Bjarne Christensen, Kirke Såby; Niels Larsen, Valby, both of Denmark

[73] Assignee: Nord-Plan Stålreoler A/A, Vipperød, Denmark

[21] Appl. No.: 926,015

[22] Filed: Oct. 31, 1986

[30] Foreign Application Priority Data

Nov. 7, 1985 [DK] Denmark ..... 5141/85

[51] Int. Cl.[4] ..... G01N 21/86; G01V 9/04

[52] U.S. Cl. ..... 250/561; 250/223 R; 414/274

[58] Field of Search ..... 250/561, 223 R; 356/4, 356/1; 364/426, 460, 461, 478, 479; 414/270, 273, 274, 277

[56] References Cited

U.S. PATENT DOCUMENTS 3,824,020 7/1974 Pease ..... 414/274

3,892,483 7/1975 Saufferer ..... 356/4

4,331,417 5/1982 Shearer, Jr. ..... 250/223 R

*Primary Examiner*—David C. Nelms

*Assistant Examiner*—Michael Messinger

*Attorney, Agent, or Firm*—Fitch, Even, Tabin & Flannery

[57] ABSTRACT

A photoelectric system for controlling storage units arranged in a row and movable along the row to form passageways between adjacent storage units. Each storage unit includes a motor for moving the storage unit in respnose to manual and automatic electric control signals. Light-operated transmitters and receivers are located on each side of each storage unit so that the transmitters and receivers of the storage units interact with each other to control movements of the storage units in a preselected manner. Mirrors are also located on each side of each storage unit so as to provide a reflective signal path between a transmitter and receiver located on an adjacent storage unit. The reflective path is completed when the storage units are spaced a preselected distance from one another. Logic circuitry for the control system is also disclosed.

6 Claims, 7 Drawing Sheets

PHOTOELECTRIC CONTROL SYSTEM FOR MOVING STORAGE UNITS

BACKGROUND OF THE INVENTION

1. Field of the Invention

The invention relates to a storage system comprising a row of storage units displaceable in two opposing directions in the longitudinal direction of the row in such a manner that a passage appears between two arbitrary neighboring storage units, each storage unit comprising driving means moving the storage unit in one or the opposite direction, said system further comprising a plurality of manually operated switch couplers operating the driving means so as to select the various passages and sensor couplers on both sides of each storage unit, each sensor coupler being activatable by a neighboring storage unit when the storage unit carrying the sensor coupler abuts the neighboring storage unit.

2. Description of the Prior Art

The known displaceable storage systems employ microswitches causing the movable storage units to stop before they bump into one another. The microswitches comprise a number of projecting contact member sometimes presenting problems in connection with, for instance, carts passing between the storage units.

SUMMARY OF THE INVENTION

Each sensor coupler is, according to the invention, a photo cell device not being activated until a predetermined distance exists between the storage units.

According to a specific embodiment the photo cell device is, according to the invention, a directional light-emitting means on a first storage unit, a light-reflecting means on an adjacent storage unit and a directional light-sensitive means on the first storage unit.

BRIEF DESCRIPTION OF THE DRAWINGS

The invention will be described in more detail below with reference to the accompanying drawing, in which.

DETAILED DESCRIPTION OF THE PREFERRED EMBODIMENT

Each storage unit is according to the invention provided with photoelectric devices causing a moving storage unit to stop at a predetermined distance from another stopped storage unit. Infrared light from a transmitter of a first storage unit is reflected by a mirror 3 on an adjacent storage unit and subsequently received by a receiver situated higher than the transmitter of the first storage unit. The directional emission of light is produced by a tube 5, cf. FIGS. 2*a* and 2*b*, lined with a light-absorbing material, a light source being situated at one end of the tube. The storage unit is advanced by means of a motor 1 in a box at the bottom of the storage unit. The only supply line is a connection to the mains. The motor 1 is provided with a tachometer causing the motor 1 to stop automatically when the storage unit meets an obstacle. The motor 1 is provided with a capacitor.

It is assumed that a large number of storage units are juxtaposed. Subsequently, the front storage unit is moved to the right whereby an activating light is emitted from one side of the storage unit, said light in turn signalling the following storage unit to move after about 3 seconds. When the front storage unit has stopped the following storage unit stops automatically at a predetermined distance relative to the stopped, front storage unit. When the following storage unit has stopped, the next storage unit of the row stops at a predetermined distance relative to storage unit No. 2 etc. in such a manner that the storage units in a row are stopped one by one.

In a preferred embodiment an activating light transmitted on the opposite side of a storage unit when said storage unit is to be activated, said activating light causing the storage unit subjected to the activation message to return a confirmation signal to the transmitter, i.e. the storage unit to be activated, reading that the latter is to remain stand-by until the activating light is switched off about 2 sec. after the moving of the previous storage unit.

Figure 1:
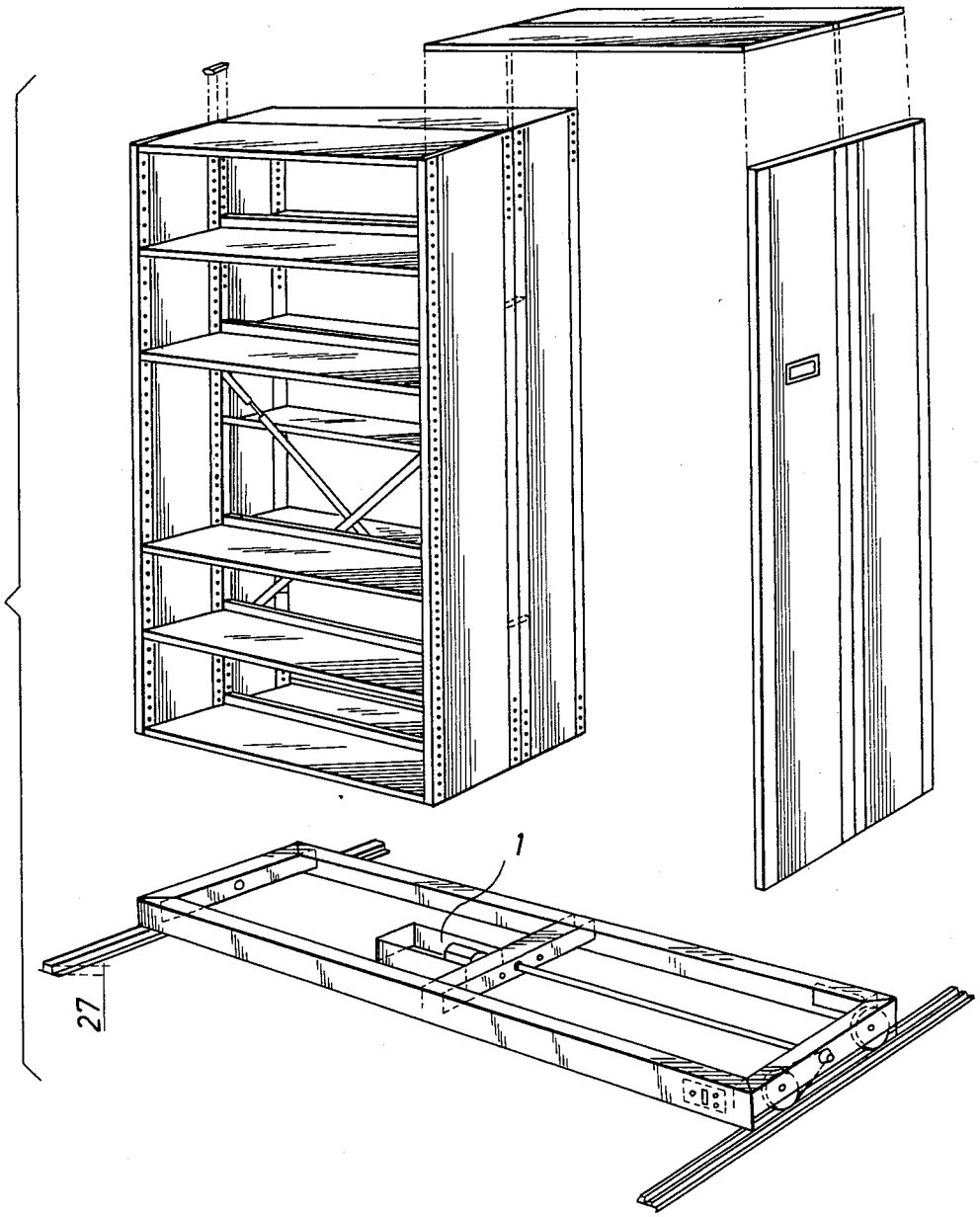
FIG. 1 illustrates a storage unit displaceable in two opposing directions.
Figure 2B:
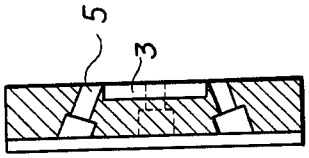
FIGS. 2*a* and 2*b* illustrate the light panel on each storage unit.
Figure 2A:
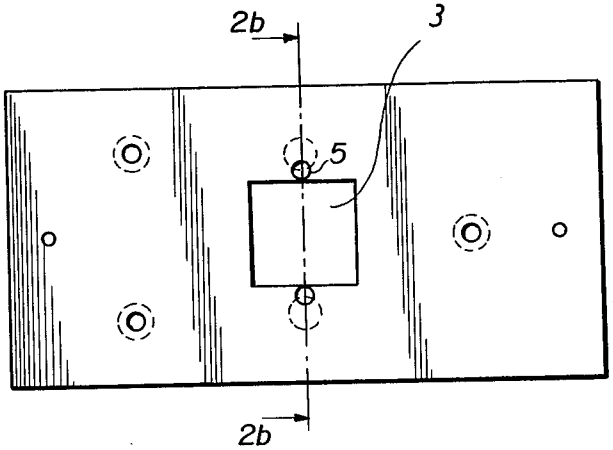
Figure 3:
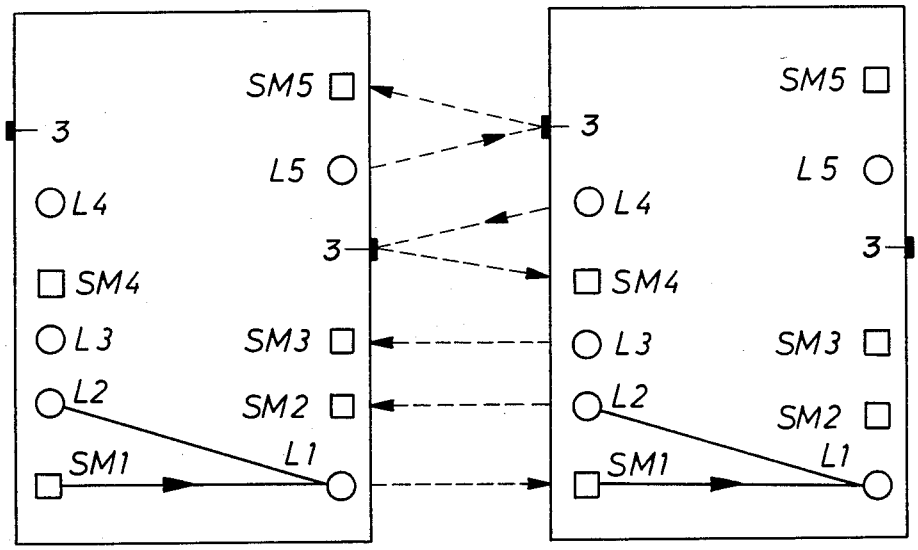
FIG. 3 illustrates the interaction between light panels of adjacent storage units.
Figure 4A:
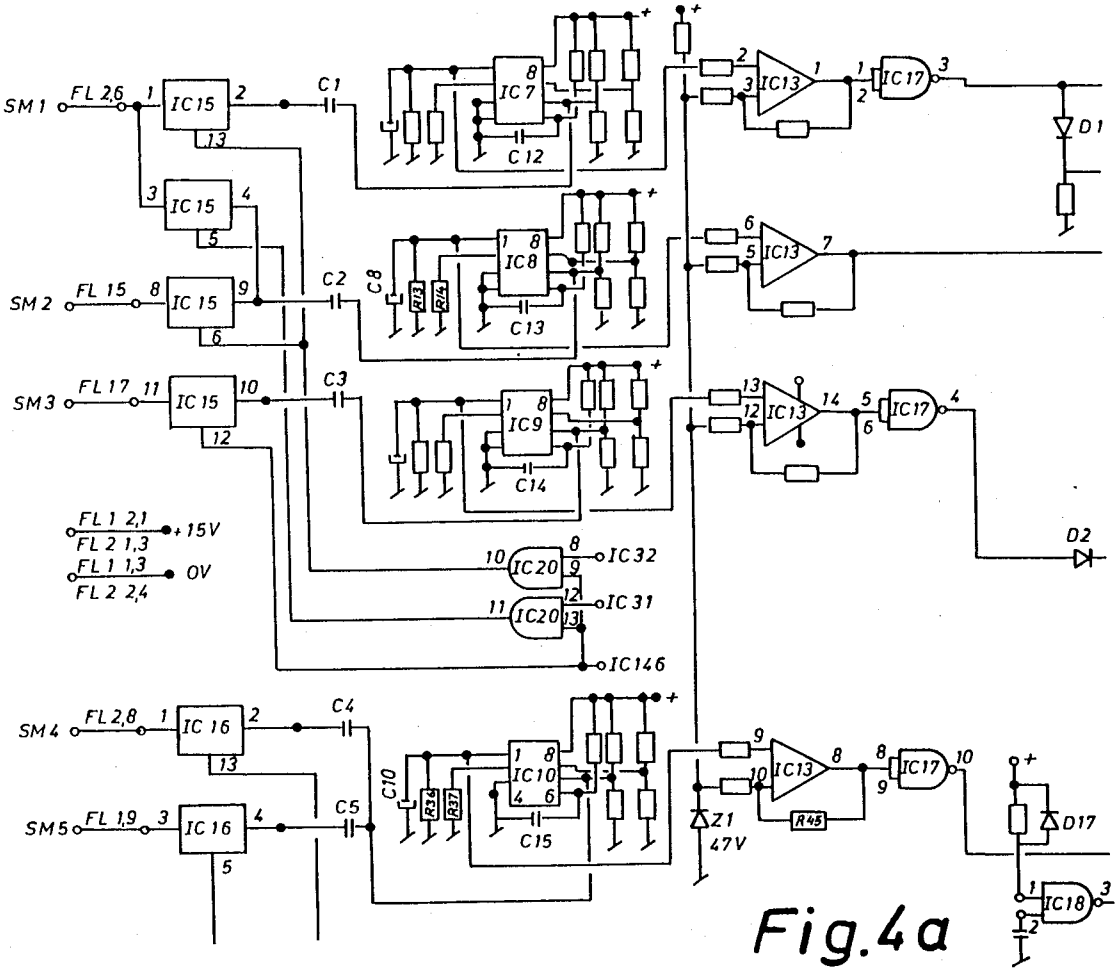
FIGS. 4*a*, 4*b*, 4*c* and 4*d* illustrate the associated logic.
Figure 4B:
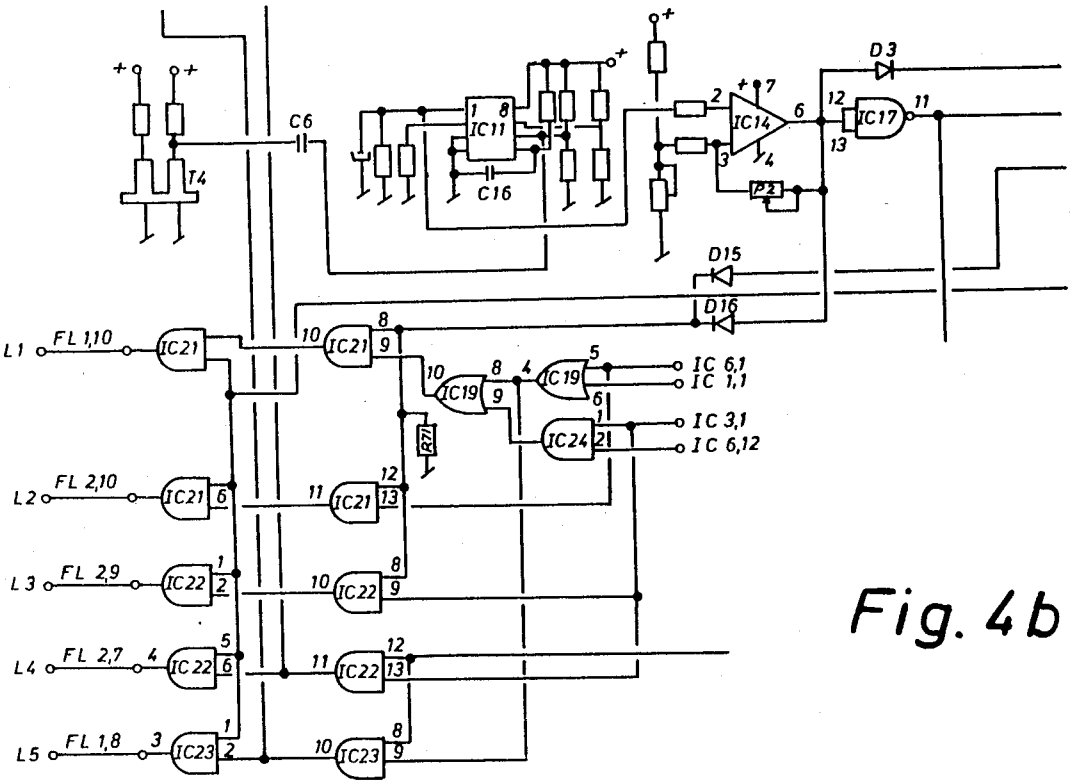
Figure 4C:
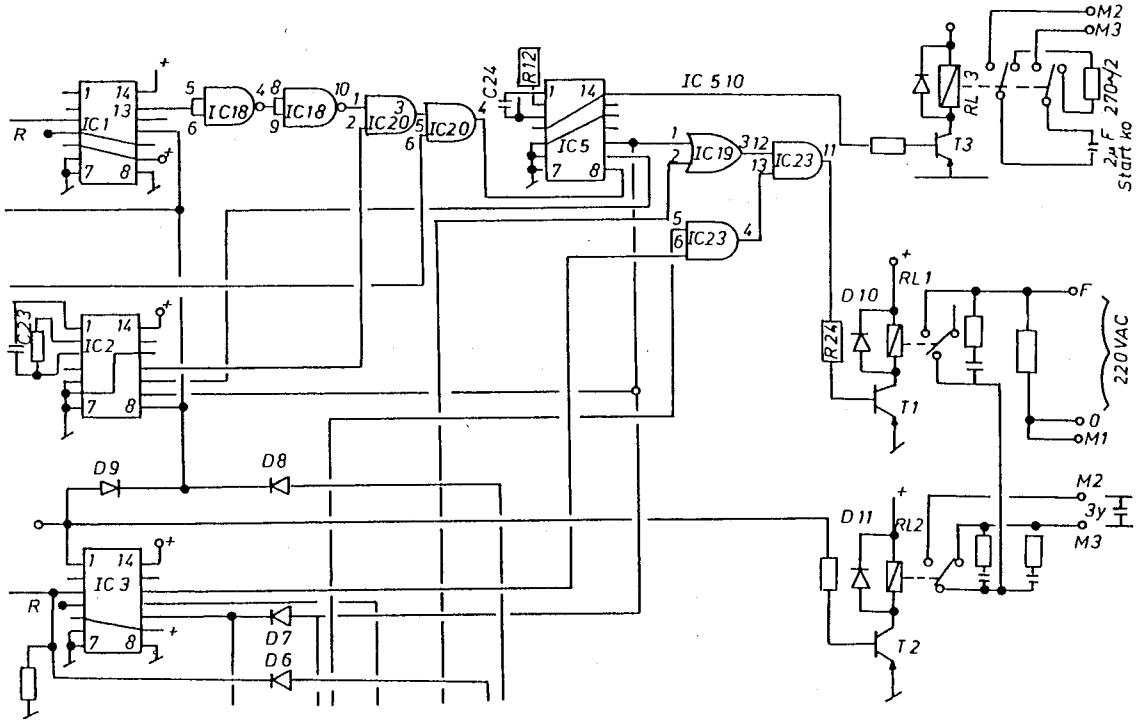
Figure 4D:
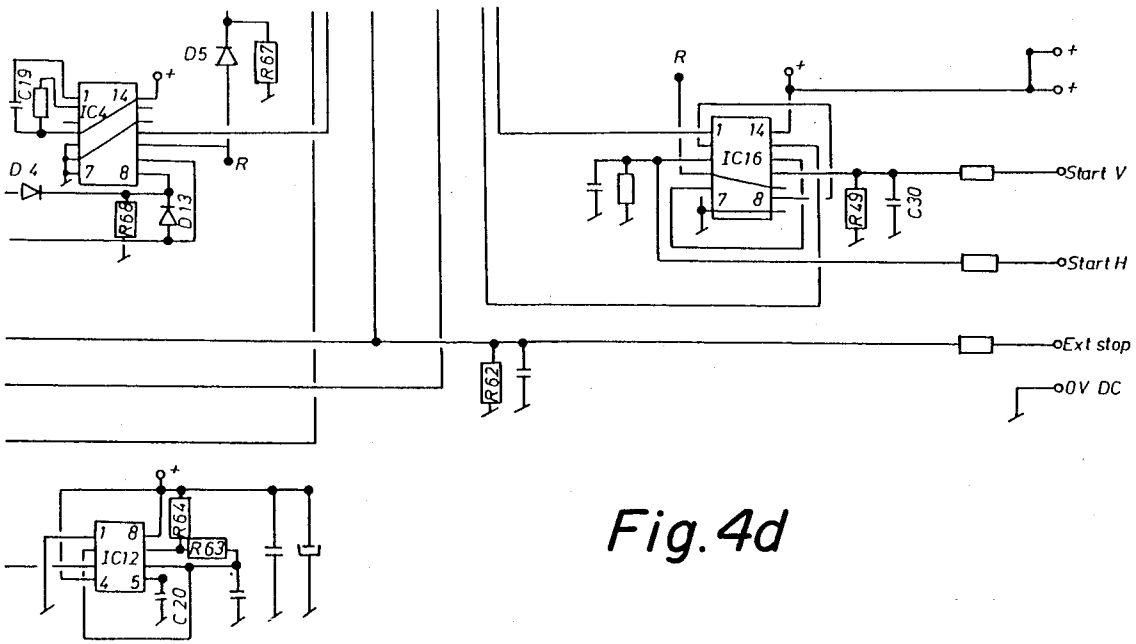

FIGS. 2*a*, 2*b* and 3 illustrate the photoelectric devices in question whereas FIGS. 4*a*–4*d* illustrates the associated logic circuitry.

Legs 1 and 4 of an analogous switch IC15 constitute the input for the activating signal from a light unit SM1 on the side of a movable storage unit, said light unit being a light diode or a receiver. The activating signal passes through IC15 and is, for instance, a light frequency. A stopped storage unit to be moved is now subjected to light through SM1. The signal passes through IC15 to a frequency-voltage converter IC7 converting the frequency into a voltage. The voltage is transmitted to a voltage comparator IC14. When the voltage exceeds 4.7 V the comparator IC13 delivers a signal to an inverter IC17. The inverted signal activates a flip-flop IC1. At the same time a signal passes a diode D1 and activates a timer IC2. The timer IC2 produces a delay preventing the storage unit from moving until a signal has been emitted by a blocking receiver SM2. When a light signal is received by the blocking receiver SM2, leg 7 of IC13 is switched to 0 V and activating signals are thereby prevented from reaching the activating timer IC5.

When the timer IC2 is activated the other half of the flip-flop IC1 is activated too by means of legs 11 and the output 13 goes high. The output signal is passed through two inverters IC18 causing a minor delay. The delayed signal implies that the output of IC20 goes high. As leg 2 of IC20 senses the timer IC2, said timer is therefore low, indicating that nothing can occur as long as the timer 102 remains active for 200–300 milleconds. A mere detection of the light is therefore sufficient. When subjected to a blocking light from SM2 the timer returns to normal, i.e., leg 2 goes high and an activating signal appears on leg 1 of IC20. Leg 3 of IC20 then assumes the value "1" and enters leg 5 of IC20, and as no blocking signal was transmitted to the storage unit, leg 6 of IC20 is also high, which allows an activation of the starting timer IC5. The starting period of the starting time meter IC5 is 2 sec. The signal of the starting timer IC5 is transmitted to IC19 and IC23 and activates a driving relay RL1 of the transistor T1. when the starting timer IC5 is activated it activates a relay RL3 for the connecting of an extra starting capacitor.

If it is desired to operate in the opposite direction, i.e., to the left, an activating light is transmitted into SM3, said signal passing through a frequency-voltage converter and producing a voltage level. This signal activates the flip-flop IC3 which in turn activates a relay RL2 oscillating between the windings of the motor. Simultaneously with the activation of the latter relay RL2, the flip-flop activates the timer IC2 to cause blocking for a few hundred milliseconds whereby problems are avoided. The flip-flop IC1 is furthermore activated by the above flip-flop.

The leg 13 goes high and the entire procedure is repeated. When IC3 is activated by the operation to the left, an analogous switch IC15, i.e. leg 3 and 4, switches the receivers. As a result, a frequency circuit is saved and the receivers have changed position in such a manner that the receivers previously being the starting receivers when operating to the right now operate as blocking receivers, i.e., now they receive the signal optionally entering SM1. Instead of being transmitted to the legs 1 and 2 of IC15, the signal is transmitted to the legs 3 and 4 and enters a blocking receiver or a frequency-voltage converter IC8 so as to pass the comparator to IC20. When the signal is blocking, leg 6 of IC20 is 0 and when it is not blocking, the leg 6 goes high.

SM4 and SM5 are blocking receivers in the first and the second side, respectively.

T4 is an optical fork situated at the tachometer disc. T4 comprises a small emitting infrared light diode and a small receiver. The light diode emits light through R50 and the light is transmitted into a cavity R51. The signal from the detecting fork T4 is transmitted to a frequency-voltage converter IC11, converting the frequency into a voltage level. The level of the stop is determined by the potentiometers P1 and P2.

The detecting fork T4 scans some openings in the tachometer disc, usually rotating at a rate of about 1450 revolutions per minute corresponding to the frequency when the motor is running. The latter frequency is transferred to the frequency-voltage converter IC11, delivering a voltage to a comparator IC14. The set-point and the reduction of the speed are set at the potentiometers P1 and P2 which causes the operation to stop. When an activation signal has been emitted and the starting timer has transmitted a signal to the driving relay RL3, a forced activation has been applied, said activation lasting for about 2 seconds, whereafter a signal is transmitted by IC17. This signal passes IC19 and IC23 whereby T1 is kept activated and the driving relay RL3 is drawing. When the speed is reduced, for instance if the storage unit meets an obstacle, the frequency is altered whereby the voltage of leg 7 of IC11 is reduced. At a point when the speed is lower than the speed of the set-point, the comparator IC14 is caused to switch and activate flip-flop IC3 through a diode 3. Leg 11 of the IC3 delivers a voltage of 0 V to leg 6 of IC23 and when one of these inputs is 0 V the output is 0 V too, indicating that the output is transferred to leg 13 of IC23 and zeroes even if the value "1" has been transferred to the OR gate IC19 (which is no longer the case). However, it shifts to zero whereby T1 is also shifted to zero and is extinguished. When IC3 receives an emergency stop pulse it goes to zero instantaneously and the storage unit stops, said flip-flop IC3 being an emergency stop flip-flop. The flip-flop IC3 is activated and its output usually being "1" alters to 0 and transfers said signal level to IC23. IC12 below IC17 is an oscillating circuit modulating the signal transmitted. The activating light for one of the other storage units is turned on at a predetermined frequency so as to exclude irrelevant signals.

L1–L5 constitutes the light panel in the left and the right side, respectively. L1 is turned on when the procedure to the right applies, and L3 presents the procedure to the left. L2 emits a blocking light when light is supplied from a storage unit. L2 is not activated by the procedure to the right and the activating button is manually operated as no need for such a procedure applies. The latter procedure only applies when SM1 is subjected to light, and L2 is only turned on in case of a remote controlled signal. L3 is turned on when the procedure to the left applies and then L1 is used as a blocking light, cf. legs 3, 4, and 5 of the analogous switch IC15. This switch is capable of switching between the receiver SM2 and the receiver SM1 in such a manner that when the procedure to the left applies SM1 is used as a blocking receiver instead of L4 and SM4 being blocking receivers when the tachometer signal is "1" and the storage unit is moving to the correct side. The procedure is not initiated until the storage unit is moving to the left and then the blocking receiver is also activated when the tachometer signal applies.

LOGIC CIRCUITRY WITH L1–L5

IC21 is a modulation circuit receiving the oscillator signal. When L1 is iluminated, the oscillator light is switched on and off at a frequency determined by IC21. L1 can only be illuminated when leg 1 of IC6 or leg 1 of IC1 has been activated, e.g. in case of a manual activation. L1 is illuminated when the storage unit is to be moved to the right. When the procedure to the left applies, SM1 and L1 are used as blocking circuits. The important feature is that the light is modulated at a specific frequency because the entire outer part facing L1–L5 is used exclusively to switch the light on and off at this frequency. The following row of AND gates is used for indicating the circumstances where they are allowed to be illuminated. It is for instance no use to switch on L1 during a procedure to the right in such a manner that L3 is illuminated in the backward direction. L2 is not allowed to be illuminate either when a manual operation is initiated and the storage unit is to be moved to the right. There is no need for L3 being illuminated in the backward direction, as the storage unit need not remain stopped.

We claim:

1. A storage system comprising a row of double-sided storage units displaceable in two opposing directions in the longitudinal direction of the row in such a manner that a passage appears between opposing sides of two neighboring storage units, each storage unit comprising driving means moving the storage unit in one or the opposite direction, said system further comprising a plurality of manually operated switch means connected to the driving means of at least one storage unit so as to control the movement thereof in a preselected manner, at least one light operated coupler on each side of each storage unit including at least one light activated sensor coupler on one storage unit activatable by a light operated coupler of an abutting neighboring storage unit and means associated with each storage unit connecting the light activated sensor coupler thereof to the driving means thereof so as to control the movement thereof when the storage unit is spaced a predetermined distance from a neighboring storage unit.

2. A storage system as claimed in claim 1, wherein the light-operated couplers on two adjacent storage units comprise a light-emitting means on a first storage unit, a reflecting means on an abutting storage unit, and a light-sensitive means comprising said light-activated sensor coupler on the first storage unit.

3. A storage system as claimed in claim 2, wherein the light emitting means emits infrared light.

4. A storage system as claimed in claim 1 wherein, when a first storage unit in a serial succession of first, second and third storage units is moved, the second storage unit transmits a ready-to-move signal to the third storage unit, the third storage unit in response thereto sends a confirmation signal to the second storage unit, and the second storage unit includes time delay means responsive to said confirmation signal to delay operation of the driving means of the second storage unit for a preselected time delay period at least as great as two seconds.

5. A storage system as claimed in claim 4, wherein the time delay period is three seconds.

6. A storage system as claimed in claim 1, wherein the light activated sensor coupler operates by means of infrared light.

* * * * *

UNITED STATES PATENT AND TRADEMARK OFFICE

CERTIFICATE OF CORRECTION

PATENT NO. : 4,761,562

DATED : August 2, 1988

INVENTOR(S) : Bjarne Christensen et al.

It is certified that error appears in the above-identified patent and that said Letters Patent is hereby corrected as shown below:

FACE OF THE PATENT:

In the "ABSTRACT", change "respnose" to --response--.

The name of the "Assignee" should read --Nord-Plan Stålreoler A/S--.

IN THE SPECIFICATION:

Column 1, line 25, change "member" to --members--.

Column 2, line 14, after "light" insert --is--.

Column 2, line 24, change "illustrates" to --illustrate--.

Column 2, line 53, change "102" to --1C2--.

Column 2, line 53, change "milleconds" to --milliseconds--.

Column 2, line 64, change "when" to --When--.

Column 4, line 25, after "Circuitry" insert --associated--.

Column 4, line 27, change "iluminated" to --illuminated--.

Column 4, line 42, change "illuminate" to --illuminated--.

UNITED STATES PATENT AND TRADEMARK OFFICE

CERTIFICATE OF CORRECTION

PATENT NO. : 4,761,562

DATED : August 2, 1988

INVENTOR(S) : Bjarne Christensen et al.

It is certified that error appears in the above-identified patent and that said Letters Patent is hereby corrected as shown below:

Column 4, line 65, change "the" to -- that --.

Signed and Sealed this

Fourteenth Day of March, 1989

*Attest:*

DONALD J. QUIGG

*Attesting Officer*

*Commissioner of Patents and Trademarks*